US005186361A

United States Patent [19]

Williams

[11] Patent Number: 5,186,361

[45] Date of Patent: Feb. 16, 1993

[54] SPRAY DISPENSER HAVING MANUAL ACTUATOR FOR GENERATING AND STORING PRODUCT-EXPELLING ENERGY

[75] Inventor: John E. Williams, Panorama City, Calif.

[73] Assignee: Williams Dispenser Corporation, Los Angeles, Calif.

[21] Appl. No.: 649,029

[22] Filed: Feb. 1, 1991

[51] Int. Cl.[5] ..... B65D 35/28; B67D 5/42; B67D 5/60

[52] U.S. Cl. ..... 222/95; 222/105; 222/386.5; 222/387; 222/389; 222/464; 222/340

[58] Field of Search ..... 222/94, 95, 105, 131, 222/183, 207, 209, 211, 212, 214, 252, 320, 321, 336, 337, 339-341, 386, 386.5, 387, 389, 390, 394, 398, 401, 402.1, 464

[56] References Cited

U.S. PATENT DOCUMENTS

| | | | |
|---|---|---|---|
| 1,197,210 | 9/1916 | Jordan | 222/104 X |
| 1,476,946 | 12/1923 | Bessessen | 222/340 |
| 1,609,424 | 12/1926 | Paul . | |
| 1,664,936 | 4/1928 | Lyman | 222/340 |
| 1,717,672 | 6/1929 | Fitch | 222/340 |
| 1,762,943 | 6/1930 | Zauder | 222/390 |
| 2,477,875 | 8/1949 | Hutchason | 222/95 |
| 2,506,833 | 5/1950 | Hunter | 222/340 |
| 2,608,320 | 8/1952 | Harrison, Jr. | 222/401 UX |
| 2,684,183 | 7/1954 | Werner | 222/340 X |
| 2,728,097 | 12/1955 | Seifert . | |
| 2,738,905 | 3/1956 | Olson | 222/387 |
| 2,752,067 | 6/1956 | Kohl et al. . | |
| 3,195,168 | 7/1965 | Roberts | 401/180 X |
| 3,207,385 | 9/1965 | Featherstone et al. | 222/389 |
| 3,240,394 | 3/1966 | Modderno | 222/95 |
| 3,246,802 | 4/1966 | Fuhrmann | 222/95 |
| 3,312,378 | 4/1967 | Featherstone et al. | 222/389 |
| 3,561,644 | 2/1971 | Works | 222/95 |
| 3,613,963 | 10/1971 | Berkmuller | 222/389 |
| 3,674,179 | 7/1972 | Galloway | 222/464 X |
| 3,815,787 | 6/1974 | Spies | 222/390 |
| 3,847,304 | 11/1974 | Cohen | 222/105 |
| 3,871,553 | 3/1975 | Steinberg | 222/95 |
| 3,873,003 | 3/1975 | Seiferth et al. | 222/95 |
| 3,951,310 | 4/1976 | Steiman | 222/340 X |
| 3,984,034 | 10/1976 | Cohen | 222/389 |
| 4,047,645 | 9/1977 | Caliendo | 222/386.5 |
| 4,077,544 | 3/1978 | Malacheski et al. | 222/340 X |
| 4,159,790 | 7/1979 | Bailey | 222/464 X |
| 4,220,264 | 4/1982 | Gamadia | 222/207 |
| 4,323,177 | 4/1982 | Nielsen | 222/386 |
| 4,341,330 | 7/1982 | Mascia et al. | 222/401 |
| 4,556,156 | 12/1985 | Frutin | 222/389 |
| 4,907,727 | 3/1990 | Ernst et al. | 222/386.5 |
| 5,042,696 | 8/1991 | Williams | 222/386 |

FOREIGN PATENT DOCUMENTS

| | | | |
|---|---|---|---|
| 1179121 | 5/1959 | France | 222/340 |
| 1570600 | 6/1969 | France | 222/95 |
| 2208113 | 3/1989 | United Kingdom | 222/95 |

*Primary Examiner*—Kevin P. Shaver
*Attorney, Agent, or Firm*—Burns, Doane, Swecker & Mathis

[57] ABSTRACT

A spray dispenser includes a manually actuable discharge valve at a longitudinal end thereof. The dispenser dispenses a product carried by a flexible bag. A body encompasses the bag to form a gas-containing space therebetween. The body is formed of a stiffer material than the bag. The dispenser includes a manual actuator which enables a user to collapse the body in order to compress the gas disposed within the space. The collapsed gas stores energy capable of pressurizing the bag and the product contained therein. Upon actuation of the valve, the pressurized product is expelled. When the gas energy is dissipated, the body is further collapsed to generate and store additional energy.

18 Claims, 2 Drawing Sheets

SPRAY DISPENSER HAVING MANUAL ACTUATOR FOR GENERATING AND STORING PRODUCT-EXPELLING ENERGY

BACKGROUND OF THE INVENTION

The present invention relates to a spray dispenser, especially a hand-held spray can in which a spray is emitted upon manual actuation of a valve.

Hand-held spray dispensers are known in which a liquid product is contained within a flexible bag situated within a cylinder. Gas occupies a space between the bag and the cylinder. The gas, which has been pre-pressurized at the factory, functions to constantly compress the bag for expelling the contents whenever a discharge valve of the dispenser is depressed. In order to ensure that a sufficient amount of pressurized gas is available for discharging the entire liquid contents of the bag, a hydrocarbon-containing gas is usually employed. Such a gas is, however, generally realized as constituting an environmental pollutant.

Hand-held spray dispensers are also known in which a piston is housed within a container below a product to be dispensed, the product possibly being disposed within a flexible bag. By advancing the piston toward a valved end of the container, the bag is compressed to expel the product. Exemplary of such devices are the disclosures of U.S. Pat. Nos. 1,197,210; 2,728,097; 3,195,168; and 3,815,787. An advantage of a dispenser in which the product is pressurized by a mechanically-advanced piston is that no environmentally polluting gases are needed.

In the above-mentioned U.S. Pat. Nos. 1,197,210 and 3,815,787, the piston carries external screw threads which mate with internal screw threads of an outer sleeve. When the outer sleeve is rotated, the piston is longitudinally advanced to collapse a bag in which the product is carried. One shortcoming of such an arrangement is that liquid or solid products carried by the bag cannot be compressed to store energy. Hence, the piston must be advanced simultaneously with actuation of the valve in order to dispense the product.

It is conventional to use a multi-piece piston having a spring disposed between the pieces in order to store energy (see above-mentioned U.S. Pat. No. 3,195,168). However, a spring-biased piston does not always impart a continuously uniform pressure to the product, whereby the spray may not be uniform.

Another shortcoming of the arrangements disclosed in U.S. Pat. Nos. 1,197,210 and 3,815,787 involves the need to prevent rotation of the piston in order to ensure that the piston will advance longitudinally in response to rotation of the outer sleeve. In U.S. Pat. No. 3,815,787, that result is achieved by the provision of a stationary thin-walled cylinder having longitudinal guide slots into which radial lugs of the piston project. The thin-walled cylinder forms an inner wall of the bag-containing body, whereby there exists the possibility that the bag could become pinched between the guide slots and the piston and thus be ruptured as a consequence.

In U.S. Pat. No. 1,197,210 the piston is attached directly to the bag which means that the bag will tend to become twisted when resisting rotation of the piston unless the bag is formed of a relatively rigid material. Such material, however, will impede the collapsing of the bag, requiring that considerable force be applied to advance the piston.

SUMMARY OF THE INVENTION

The present invention relates to a spray dispenser comprising a housing which carries a discharge valve at a longitudinal end thereof. A flexible bag is connected to the housing for carrying a product in communication with the discharge valve. The housing includes a body which encompasses the bag and forming a gas-containing space therebetween. The body is formed of a stiffer material than the bag. A manual actuator is provided which collapses the bag in order to compress the gas and thereby pressurize the product. Accordingly, the compressed gas stores energy for expelling the product upon actuation of the discharge valve.

Preferably, the manually actuable member comprises a sleeve mounted for rotation relative to the body. A piston is disposed within the sleeve and is threadedly connected thereto so as to be displaced longitudinally in response to rotation of the sleeve relative to the body.

The body preferably contains preformed weakening lines, such as a bellows configuration, to promote longitudinal collapsing of the body b the piston.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
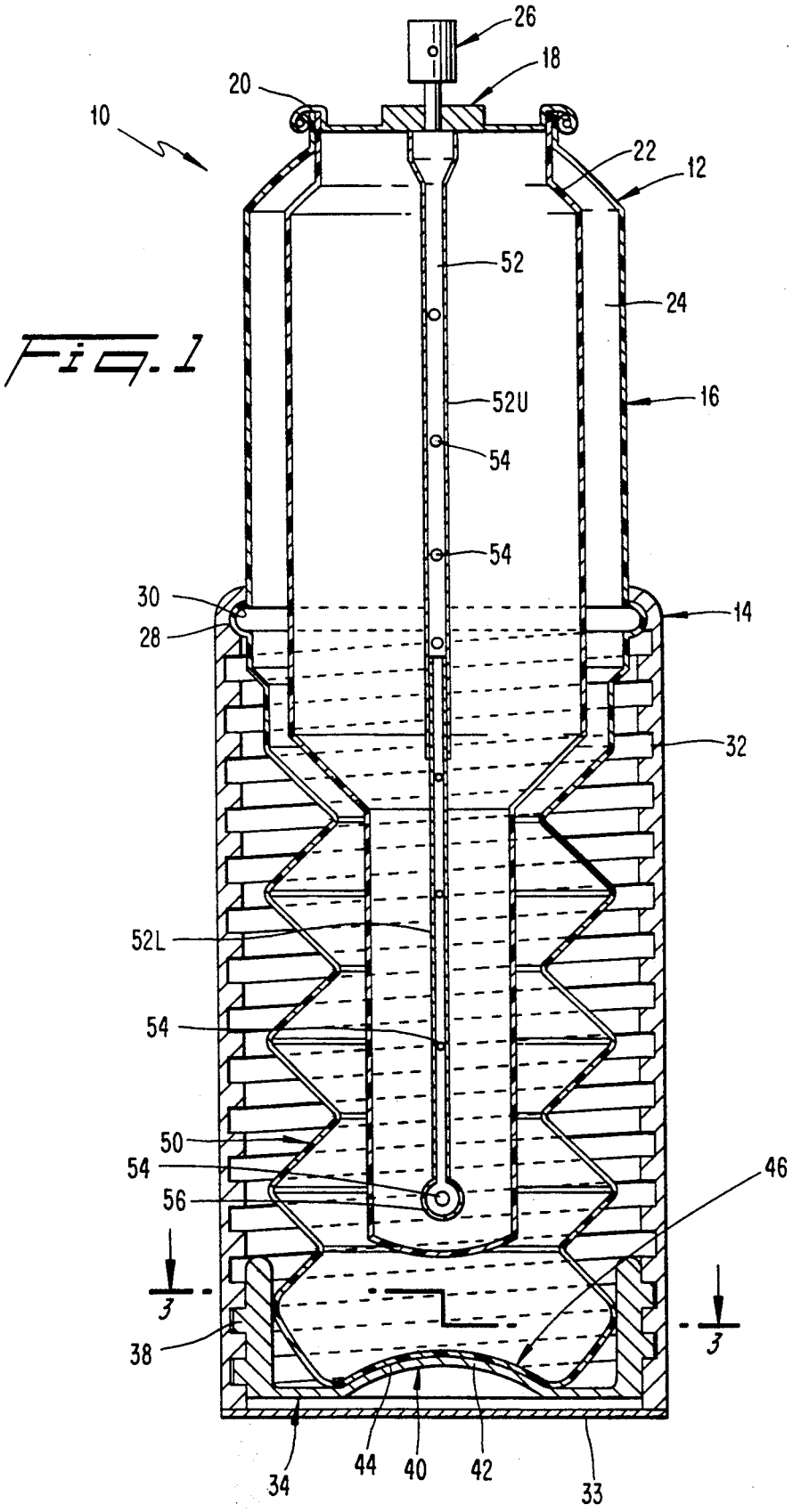
FIG. 1 is a longitudinal sectional view through a spray dispenser according to the present invention.

A spray dispenser 10 according to the present invention includes a housing 12 comprised of an outer sleeve 14, an inner body 16, and an end plate 18. An upper end of the inner body is joined to the end plate 18 by a crimped outer edge 20 of the plate 18. The crimped edge also clamps an upper end of a flexible bag 22 which hangs within a chamber 24 defined by the housing 12. A conventional manually actuable valve 26 is mounted to the end plate for discharging a liquid product carried by the bag.

The upper end of the outer sleeve 14 is disposed below an upper end of the inner body and includes an annular groove 28 which receives an annular bead 30 of the inner body for permitting the outer sleeve 14 to rotate relative to the inner body about a longitudinal (vertical) axis of the dispenser. An inner cylindrical surface of the outer sleeve 14 is provided with an internal screw thread 32. A lower closure plate 33 extends across a lowermost end of the outer sleeve 14.

Disposed within the outer sleeve 14 beneath the inner body 22 is a piston 34. The piston is cup-shaped and includes an upstanding skirt portion 36 into which the lower end of the inner body 16 extends.

An external screw thread 38 is provided on an outer cylindrical surface of the skirt portion and is connected to the internal thread 32 of the outer sleeve. A base portion 40 of the piston includes an upward projection 42 which fits into a downwardly opening slot 44 formed in a floor 46 of the inner body 16. The inner body, which is stiffer than the bag 22, is formed of a relatively stiff metal or plastic material (e.g., PVC, aluminum, etc.) so that when the outer sleeve 14 is rotated in a given direction relative to the inner body about the longitudinal axis, the piston is held against rotation by the inner body and is caused to be longitudinally raised.

Figure 2:
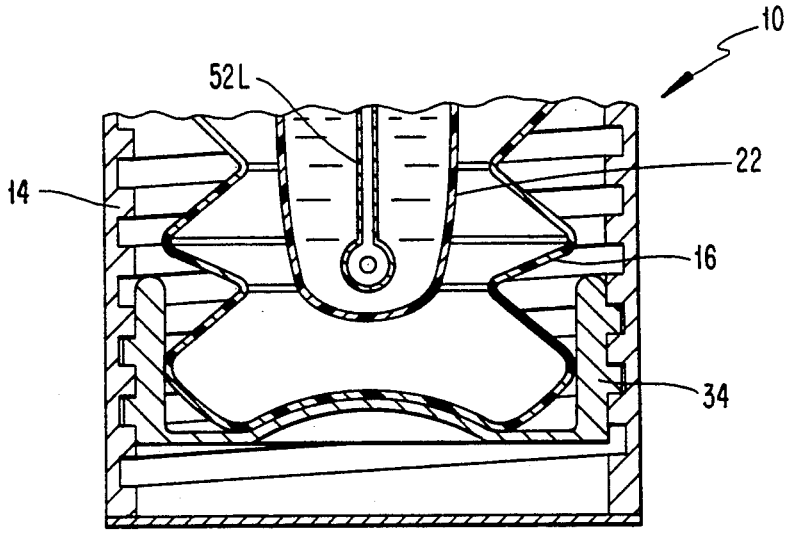
FIG. 2 is a fragmentary view of FIG. 1 after a piston element of the dispenser has been slightly raised to partially collapse a bag element of the dispenser.
Figure 3:
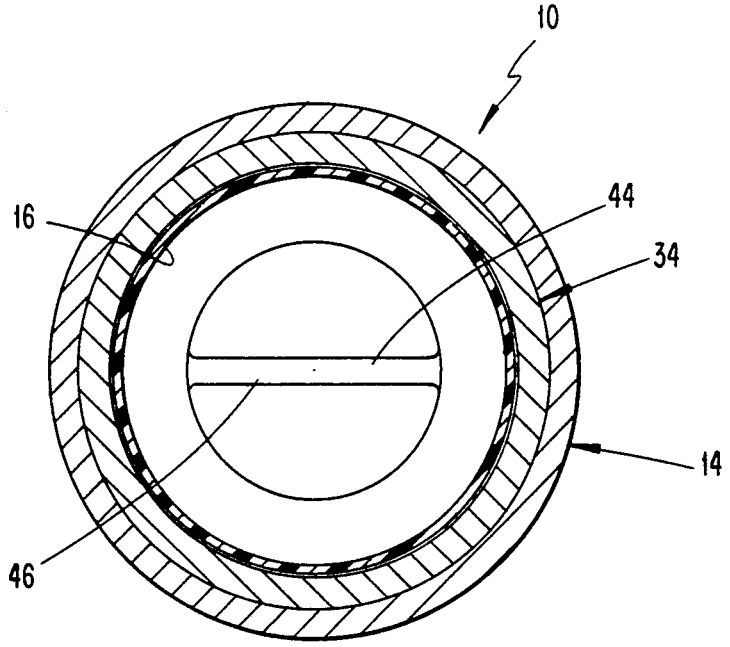
FIG. 3 is a cross-sectional view taken along the line 3—3 in FIG. 1.

The lower portion of the inner body is provided with preformed weakening lines to promote collapsing of the body. This is achieved by providing the body with a bellows configuration 50, enabling the inner body to be collapsed in the direction of the longitudinal axis (see FIG. 2). Thus, as the piston 34 is raised, it pushes against, and longitudinally collapses, the inner body. As that occurs, the volume of the space formed between the bag 22 and the inner body 16 is reduced, thereby compressing a gas, e.g., air, disposed within that space. The pressurized gas thus pressurizes the bag 22 by uniform forces throughout the bag outer perimeter. By thus uniformly pressurizing the bag, a positive, uninterrupted, constant-pressure discharge of the liquid product from the bag will tend to occur when the valve 26 is actuated. Furthermore, the compressed gas constitutes a supply of stored energy (i.e., it functions as a gas spring) to enable a single prolonged discharge, or a plurality of short discharges, to be made.

Although the product may be permitted to travel directly from the bag to the valve 26, it may be desirable to provide a hollow diptube 52 attached in suitable fashion to the end plate 18 (e.g., by adhesive or welding) and projecting downwardly through the center of the bag 22. The diptube 52 contains vertically spaced apertures 54 into which the liquid can flow. The presence of the diptube 52 is intended to ensure that the entire uncollapsed portion of the bag communicates with the valve. That is, in the absence of the diptube, a middle portion of the bag could be pinched shut, thus isolating the lower portion of the bag from the valve. However, the presence of the diptube and its apertures 54 prevents such isolation from occurring and enables the product disposed in the lower portion of the bag to travel to the valve 26.

In order to accommodate the eventual longitudinal collapsing of the inner body 22, the diptube 52 is collapsible longitudinally. That is, the diptube includes upper and lower telescoping segments 52U, 52L. As the inner body 16 collapses, the lower segment 52L will be pushed upwardly within the upper segment 52U.

The bottom end of the lower segment 52L is shaped as a bulb 56 with an aperture 54 formed in a side portion thereof. That aperture will not be closed off even if the bottom of the bag is pushed upwardly against the lowermost end of the lower segment 52L.

In order to discharge a spray of product, the upper portion of the inner body 16 is grasped by one hand of the user who, with the other hand, rotates the outer sleeve 14. As a result, the piston travels upwardly to longitudinally collapse the inner body 16. The space between the inner body and the bag 22 also collapses, thereby pressurizing the gas therein. The compressed gas constitutes stored energy which uniformly pressurizes the bag 22 and its contents. Hence, whenever the valve 26 is actuated, a continuously uniform spray of product is emitted until the gas pressure around the bag dissipates. At that point, the piston can again be raised to further compress the gas.

The components of the dispenser are formed of any suitable plastic or metal material, although the bag 22 should be formed of plastic.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A spray dispenser comprising a housing carrying a discharge valve at a longitudinal end thereof, a flexible bag connected to said housing for carrying a liquid product in communication with said discharge valve, said housing including a body encompassing said bag and forming a gas-containing space therebetween, said body being formed of a stiffer material than said bag, and manually actuable means for collapsing said body to compress said gas and thereby pressurize said product, whereby the compressed gas stores energy for expelling product upon actuation of said discharge valve.

2. A spray dispenser according to claim 1, wherein said body includes preformed weakening lines to promote collapsing of said body along said lines.

3. A spray dispenser according to claim 1, wherein the gas in said space is air.

4. A spray dispenser according to claim 1 including a diptube extending downwardly within said bag and including vertically spaced inlet ports, an upper end of said diptube communicating with said valve.

5. A spray dispenser according to claim 4, wherein said manually actuable means is arranged to collapse said body in a longitudinal direction, said diptube including a plurality of longitudinally telescoping sections enabling said diptube to be longitudinal collapsed in response to longitudinal collapsing of said inner body.

6. A spray dispenser according to claim 1, wherein said manually actuable means includes a vertically displaceable member carried by said housing, and a manual actuator carried by said housing and connected to said vertically displaceable member for vertically displacing said vertically displaceable member into contact with said body for compressing said body.

7. A spray dispenser according to claim 6, wherein said manual actuator comprises a sleeve mounted for rotation relative to said body.

8. A spray dispenser according to claim 7, wherein said vertically displaceable member comprises a piston connected to said sleeve by a screw thread so as to be displaceable vertically in response to rotation of said sleeve.

9. A spray dispenser according to claim 7, wherein said sleeve includes an upper portion disposed below an upper end of said body, said sleeve including means connecting said sleeve to said body for enabling said sleeve to rotate relative to said body.

10. A spray dispenser according to claim 8, wherein said piston is connected to said body by a projection-and-slot connection which prevents rotation of said piston relative to said sleeve.

11. A spray dispenser according to claim 8, wherein said piston is of cup-shape, and a lower end of said body extends into an open end of said piston.

12. A spray dispenser according to claim 8, wherein said body includes a bellows shape to promote collapsing of said body in a longitudinal direction.

13. A spray dispenser according to claim 12 including a diptube extending downwardly within said bag and including vertically spaced inlet ports, an upper end of said diptube communicating with said valve.

14. A spray dispenser according to claim 13, wherein said manually actuable means is disposed below said bellows-shaped body to collapse said body in a longitudinal direction when said manually actuable means is vertically displaced, said diptube including a plurality of longitudinal telescoping sections enabling said diptube to be longitudinally collapsed in response to longitudinal collapsing of said body.

15. A spray dispenser comprising a housing carrying a discharge valve at a longitudinal end thereof, a flexible bag connected to said housing for carrying a liquid product in communication with said discharge valve, said housing including a body encompassing said bag and forming a gas-containing space therebetween, said body formed of a stiffer material than said bag, said body including preformed weakening lines for promoting collapsing of said body in a longitudinal direction, a sleeve encompassing at least a lower portion of said body and being rotatable relative thereto about a longitudinal axis, and a piston disposed within said sleeve beneath said body and connected by a screw thread to said sleeve to be longitudinally displaceable toward said discharge valve in response to rotation of said sleeve relative to said body so as to longitudinally collapse said body and compress said gas in said space, whereby the compressed gas stores energy for expelling the liquid product upon actuation of said discharge valve.

16. A spray dispenser comprising a manually operable discharge valve, a flexible bag operably connected to said discharge valve for enclosing a liquid product in communication with said discharge valve, and collapsible means encompassing said flexible bag in spaced relationship thereto to form a gas-containing space which surrounds a substantial portion of said flexible bag, manually operable means for reducing the volume of said space to compress said flexible bag and thereby pressurize said product, the compressed gas defined stored energy for expelling product upon operation of said discharge valve, said manually operable means including a manually rotatable element, and a piston disposed beneath said flexible bag, said piston being operably connected to said rotatable element by a screw thread so as to be movable toward said discharge valve and vertically against a lower end of said collapsible means in response to rotation of said manually rotatable element for collapsing said collapsible means to produce said reduction in volume of said space.

17. A spray dispenser according to claim 16, wherein said collapsible means includes a collapsible body disposed above said piston and encompassing said bag to form said space, said body being collapsible in response to movement of said piston toward said discharge valve to produce said reduction in volume of said space.

18. A spray dispenser according to claim 16, wherein said collapsible means includes a longitudinal collapsible body encompassing said body to form said space, said body being longitudinally collapsible in response to movement of said piston toward said discharge valve.

* * * * *